US008660290B2

(12) United States Patent
Yamanaka

(10) Patent No.: US 8,660,290 B2
(45) Date of Patent: Feb. 25, 2014

(54) DISPLAY DEVICE

(75) Inventor: Takahito Yamanaka, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 132 days.

(21) Appl. No.: 13/449,786

(22) Filed: Apr. 18, 2012

(65) Prior Publication Data

US 2012/0281868 A1 Nov. 8, 2012

(30) Foreign Application Priority Data

May 6, 2011 (JP) ..... 2011-103382

(51) Int. Cl.
*H04R 25/00* (2006.01)

(52) U.S. Cl.
USPC ..... 381/388; 381/333; 381/160

(58) Field of Classification Search
USPC ..... 381/332–335, 395
See application file for complete search history.

(56) References Cited

U.S. PATENT DOCUMENTS

| | | | | |
|---|---|---|---|---|
| 6,359,994 | B1 * | 3/2002 | Markow et al. | 381/333 |
| 6,415,035 | B1 * | 7/2002 | Shin et al. | 381/388 |
| 8,126,186 | B2 * | 2/2012 | Kameoka | 381/388 |
| 8,295,534 | B2 * | 10/2012 | Hamada | 381/388 |

FOREIGN PATENT DOCUMENTS

| | | | |
|---|---|---|---|
| JP | 2005-165351 | A | 6/2005 |
| JP | 3116087 | U | 10/2005 |
| JP | 2007-086240 | A | 5/2007 |
| JP | 2010-141610 | A | 6/2010 |

* cited by examiner

*Primary Examiner* — Suhan Ni
(74) *Attorney, Agent, or Firm* — Global IP Counselors, LLP

(57) ABSTRACT

A display device includes an image display component, first and second speakers, and a stand. The first and second speakers are mounted to the image display component. The first and second speakers are spaced apart from each other in a first direction of the image display component. The stand includes a base with first and second sound reflecting faces. The first and second sound reflecting faces are opposite the first and second speakers in a second direction of the image display component, respectively. The second direction is perpendicular to the first direction. The first sound reflecting face slopes downward as moving away from the second sound reflecting face and forward of the image display component. The second sound reflecting face slopes downward as moving away from the first sound reflecting face and forward of the image display component.

14 Claims, 5 Drawing Sheets

DISPLAY DEVICE

CROSS-REFERENCE TO RELATED APPLICATIONS

This application claims priority to Japanese Patent Application No. 2011-103382 filed on May 6, 2011. The entire disclosure of Japanese Patent Application No. 2011-103382 is hereby incorporated herein by reference.

BACKGROUND

Field of the Invention

The present invention generally relates to a display device. More specifically, the present invention relates to a display device having a pair of speakers.

Recent years have seen dramatic advances in flat-screen television receivers in terms of further reducing the thickness and giving the front cabinet a smaller frame width. This has been accompanied by numerous restrictions on how the speakers are laid out.

A conventional image display component of a flat-screen television receiver has a liquid crystal module, a cabinet that contains this liquid crystal module, and so forth. The cabinet is generally formed by combining a front cabinet and a rear cabinet, The liquid crystal element of the liquid crystal module faces a display window formed by the frame of the front panel. A rearward projection sticks out from the center part of the rear face of the rear cabinet. The board of the liquid crystal module and so forth are housed in the interior thereof. Furthermore, left and right speakers are arranged in left and right symmetry in front view, at the lower part on the inside of the rearward projection of the rear cabinet and at the rear of the liquid crystal module. These speakers are installed in the rear cabinet in an orientation such that they will emit sound downward.

The reasons for arranging the left speaker and the right speaker on the left and right in front view at the lower part on the inside of the rearward projection of the rear cabinet are roughly as follows.

First, to reduce the apparent thickness of the flat-screen television receiver, it is advantageous to make the periphery of the rear cabinet thinner. As a result, it is necessary to form the rearward projection in the center portion of the rear cabinet and house mechanical parts (such as the above-mentioned board) therein. Second, if speakers that can be obtained inexpensively are disposed around the periphery of a rear cabinet that has been made thinner, the size of the speakers becomes a problem in terms of installation space. Third, there are cost limitations on using expensive speakers that are compact and provide high sound quality as the speakers.

In view of this, with the flat-screen television receiver, with the above-mentioned restrictions on speaker installation and price in mind, the spacing between the left and right speakers is set as wide as possible at the lower part inside the rearward projection of the rear cabinet such that the sound outputted from the left and right speakers will be as easy to hear as possible when the user is located in front of the cabinet, and furthermore, the difference in the sound outputted from the left and right speakers will be recognized as clearly as possible when the user is located in front of the cabinet, with the goal being an improved acoustic stereo sensation.

This flat-screen television receiver also has a stand. The image display component with the cabinet, etc., is kept in an upright orientation by this stand. The stand has a flat base that is placed on the floor or a table. The upper face of the base is a flat surface.

Meanwhile, a flat-screen television receiver in which an image display component is supported by a stand has been known (see Japanese Laid-Open Patent Application Publication No. 2010-141610, Japanese Utility Model Registration No. 3,116,087, and Japanese Laid-Open Patent Application Publication No. 2005-165351, for example). Japanese Laid-Open Patent Application Publication No. 2010-141610 proposes a means for improving the stability with which a flat-screen display device is supported by a stand. Japanese Utility Model Registration No. 3,116,087 and Japanese Laid-Open Patent Application Publication No. 2005-165351 propose a means for making it easier to attach and remove the stand to and from the main body. Japanese Laid-Open Patent Application Publication No. 2005-165351 further discloses a constitution in which audio output speakers are disposed facing forward on the left and right sides of a display device (e.g., image display component). Further, Japanese Laid-Open Patent Application Publication No. 2007-86240 proposes a means for preventing a decrease in the aesthetic quality of stand that imparts cushioning in a flat-screen display device.

SUMMARY

However, with the flat-screen television receiver, the left and right speakers are installed facing down and the sound outputted from these speakers is directed downward. It has been discovered that, even though the speakers are installed close to a space that is left under the image display component, the sound pressure toward the front of the image display component ends up being lower, making it more difficult for the sound to spread out forward of the cabinet. Also, even though the spacing between the left and right speakers is set as wide as possible, this spacing is the result of taking into account the many restrictions on the layout of speakers in a flat-screen television receiver. Thus, it is difficult to make the spacing adequately wide. Accordingly, in front of the image display component, the user cannot very clearly distinguish the difference in the sounds outputted by the left and right speakers with the left and right ears. As a result, even though the left speaker and the right speaker are split apart on the left and right when viewed from the front, the acoustic stereo effect produced by the left and right speakers can be considered unsatisfactory.

It has also been discovered that, if the flat upper face of the base of the stand is located under the left and right speakers, then it is also conceivable that a certain acoustic effect will be obtained when the upper face of the base reflects the sound outputted from the speakers. However, the direction in which the sound is reflected by the upper face of the base faces upward from the base. Accordingly, this does not contribute that much to increasing the sound pressure toward the front of the image display component, and sound tends not to spread out toward the front of the image display component. Also, since the spacing between the left and right speakers is not all that wide, the acoustic stereo sensation tends to be unsatisfactory in front of the image display component.

When the technology proposed in the various Patent Literature mentioned above is used for this, it is difficult to increase the sound pressure toward the front of the cabinet of the sound outputted from the left and right speakers installed facing down, or to improve the above-mentioned stereo sensation.

An improved display device was conceived in light of the above-mentioned problem. One object of the present disclosure is to provide a display device with which the sound pressure toward the front of a cabinet is increased, and the acoustic stereo sensation is improved.

In accordance with one aspect of the present disclosure, a display device includes an image display component, first and second speakers, and a stand. The first and second speakers are mounted to the image display component. The first and second speakers are spaced apart from each other in a first direction of the image display component. The stand supports the image display component. The stand includes a base with first and second sound reflecting faces. The first and second sound reflecting faces are arranged relative to each other in the first direction of the image display component. The first and second sound reflecting faces are opposite the first and second speakers in a second direction of the image display component, respectively. The second direction is perpendicular to the first direction. The first sound reflecting face slopes downward as moving away from the second sound reflecting face and forward of the image display component. The second sound reflecting face slopes downward as moving away from the first sound reflecting face and forward of the image display component.

These and other objects, features, aspects and advantages will become apparent to those skilled in the art from the following detailed description, which, taken in conjunction with the annexed drawings, discloses a preferred embodiment.

BRIEF DESCRIPTION OF THE DRAWINGS

Referring now to the attached drawings which form a part of this original disclosure.

DETAILED DESCRIPTION OF EMBODIMENTS

A preferred embodiment will now be explained with reference to the drawings. It will be apparent to those skilled in the art from these disclosures that the Wowing descriptions of the preferred embodiment are provided for illustration only and not for the purpose of limiting the invention as defined by the appended claims and their equivalents.

Referring to FIGS. 1 to 7, a fiat-screen television receiver (e.g., display device) will be described in detail.

Figure 1:
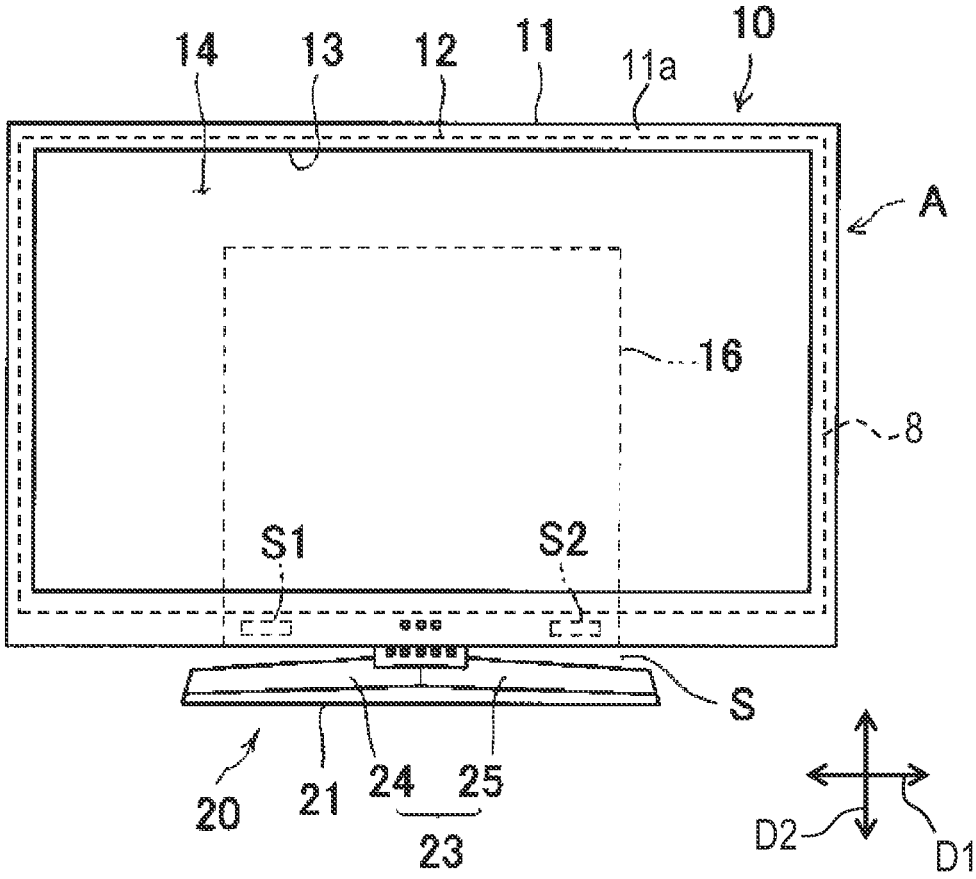
FIG. 1 is a front elevational view of a flat-screen television receiver in accordance with one embodiment.
Figure 2:
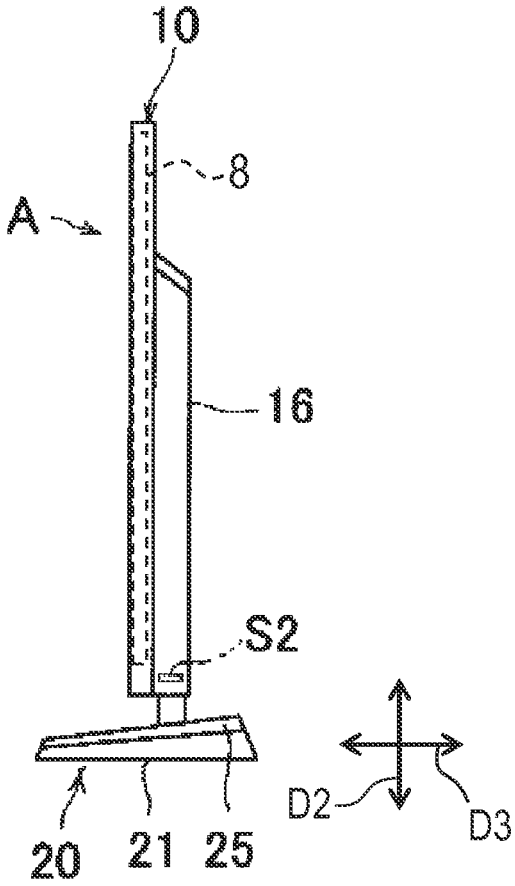
FIG. 2 is a side elevational view of the flat-screen television receiver illustrated in FIG. 1.

As shown in FIGS. 1 and 2, the flat-screen television receiver has an image display component A. The image display component A includes a liquid crystal module 8, a cabinet 10 that houses the liquid crystal module 8, and other electric components, such as a receiver, a tuner and so forth. These electric components of the flat-screen television receiver are conventionally well known. Thus, the descriptions of the electric components are omitted for the sake of brevity. The cabinet 10 is formed by combining a front cabinet 11 (e.g., front cabinet part) and a rear cabinet 15 (e.g., rear cabinet part). The liquid crystal module 8 has a liquid crystal display element 14 that faces forward through a display window 13 formed by a frame 12 of a front panel 11*a* of the front cabinet 11. The liquid crystal module 8 further has a circuit board (not shown) or the like. A rearward projection 16 (e.g., bulging portion) sticks out from the center part of the rear face of the rear cabinet 15. The circuit board and other electric components are housed in the interior of the rearward projection 16 in the center part of the rear face of the rear cabinet 15. The flat-screen television receiver further includes a left speaker S1 (e.g., first speaker) and a right speaker S2 (e.g., second speaker). The left and right speakers S1 and S2 are arranged in left and right symmetrical positions in a front view, at the lower part (e.g., bottom portion) of the cabinet 10 on the inside of the rearward projection 16 of the rear cabinet 15 and at the rear of the liquid crystal module 8. These speakers S1 and S2 are installed the rear cabinet 15 in an orientation that outputs sound downward. More specifically, the left and right speakers S1 and S2 are mounted to the image display component A within the rearward projection 16. The left and right speakers are mounted to the lower part of the cabinet 10 at a location rearward of the image display component A relative to the liquid crystal module 8. The left and right speakers S1 and S2 are spaced apart from each other in a widthwise direction D1 (e.g., first direction) of the image display component A. The left and right speakers S1 and S2 are symmetrically arranged relative to each other with respect to a center axis of the image display component A. The center axis of the image display component A extends along a height direction D2 (e.g., second direction) of image display component A. The height direction D2 is perpendicular to the widthwise direction D1.

The reasons for arranging the left speaker S1 and the right speaker S2 on the left and right in the front view at the lower part on e inside of the rearward projection 16 of the rear cabinet 15 are roughly as follows.

First, to reduce the apparent thickness of the flat-screen television receiver, it is advantageous to make the periphery of the rear cabinet 15 thinner. Thus, the rearward projection 16 in the center portion of the rear cabinet 15 houses mechanical and electrical parts (such as the circuit board) therein. Second, if speakers that can be Obtained inexpensively are disposed within the inside of the rearward projection 16, then it is advantageous to make the periphery of the rear cabinet 15 thinner even though, in view of cost limitations, expensive speakers that are compact and provide high sound quality can not be used as the speakers S1 and S2.

In view of this, with the flat-screen television receiver, with the above-mentioned restrictions on speaker installation and price in mind, the spacing W (e.g., predetermined spacing) between the left and right speakers S1 and S2 is set as wide as possible at the lower part inside the rearward projection 16 of the rear cabinet 15. With this arrangement, the sound outputted from the left and right speakers S1 and S2 can be as easy to hear as possible when the user is located in front of the cabinet 10. Furthermore, the difference in the sound outputted from the left and right speakers S1 and S2 can be recognized as clearly as possible when the user is located in front of the cabinet 10. As a result, acoustic stereo sensation can be improved.

Furthermore, the flat-screen television receiver further includes a stand 20 that supports the image display component A in an upright orientation. The stand 20 has a flat base 21 that is placed on the floor or a table. The base 21 further has an upper face 22 (e.g., top surface) that forms a reflecting face 23 for the reflecting sound outputted from the left speaker S1 and the right speaker S2. Also, this reflecting face 23 is divided in two into a left segment 24 (e.g., first sound reflecting face) located under the left speaker S1 and a right segment 25 (e.g., second sound reflecting face) located under the right speaker S2. The left and right segments 24 and 25 are arranged relative to each other in the widthwise direction D1 of the image display component A. The left and right segments 24 and 25 are opposite the left and right speakers S1 and S2 in the height direction D2 of the image display component A, respectively. In other words, the left and right speakers S1 and S2 are arranged such that at least sound exit portion of the left and right speakers S1 and S2 overlap the left and right segments 24 and 25, respectively, as viewed in the height direction. Furthermore, the left and right speakers S1 and S2 are arranged relative to the left and right segments 24 and 25 such that the left and right speakers S1 and S2 emit sound in the height direction D2 toward the left and right segments 24 and 25, respectively. Furthermore, the left and right segments 24 and 25 are arranged relative to the left and right speakers S1 and S2 such that the left and right segments 24 and 25 reflects sound emitted from the left and right speakers S1 and S2, respectively. The left segment 24 and right segment 25 of the reflecting face 23 will now be further described in detail.

Figure 3:
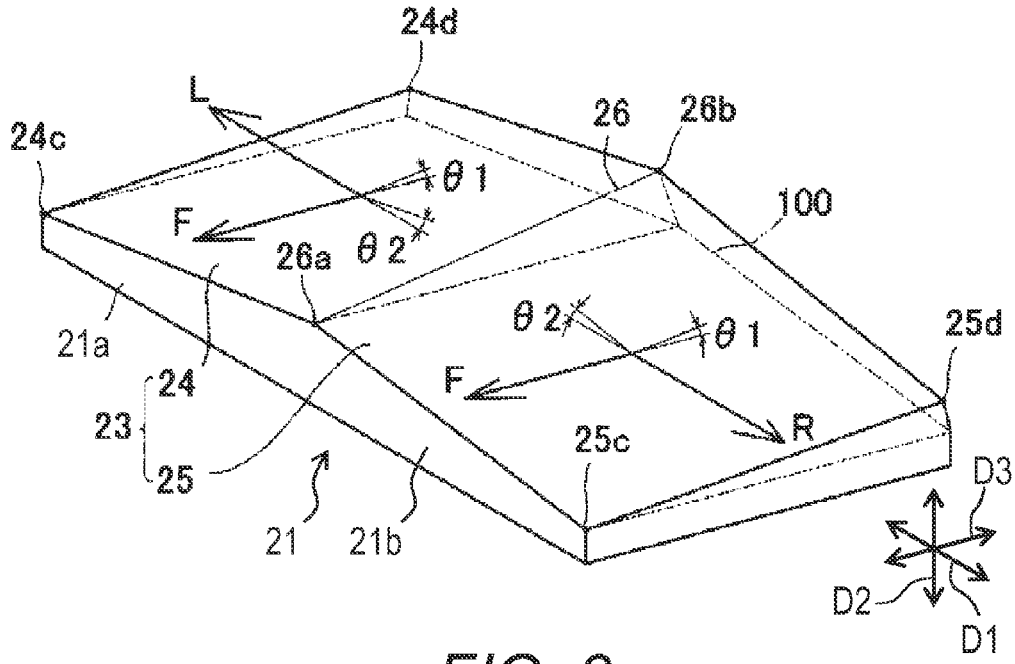
FIG. 3 is an enlarged perspective view of a base of the flat-screen television receiver illustrated in FIG. 1.
Figure 4:
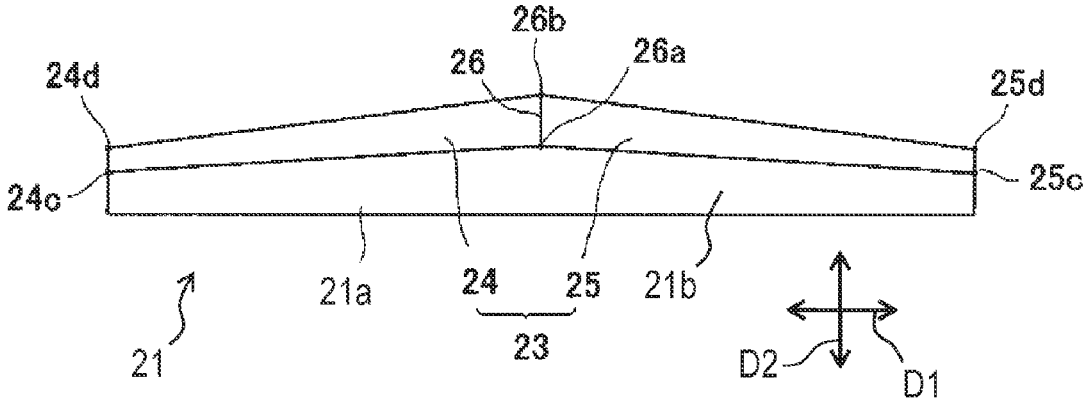
FIG. 4 is a front elevational view of the base illustrated in FIG. 3.
Figure 5:
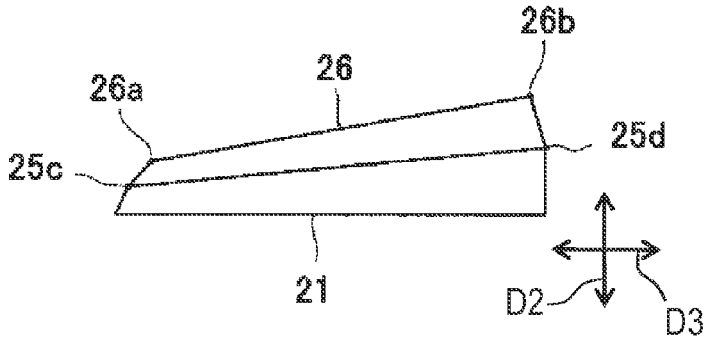
FIG. 5 is a side elevational view of the base illustrated in FIG. 3.
Figure 6:
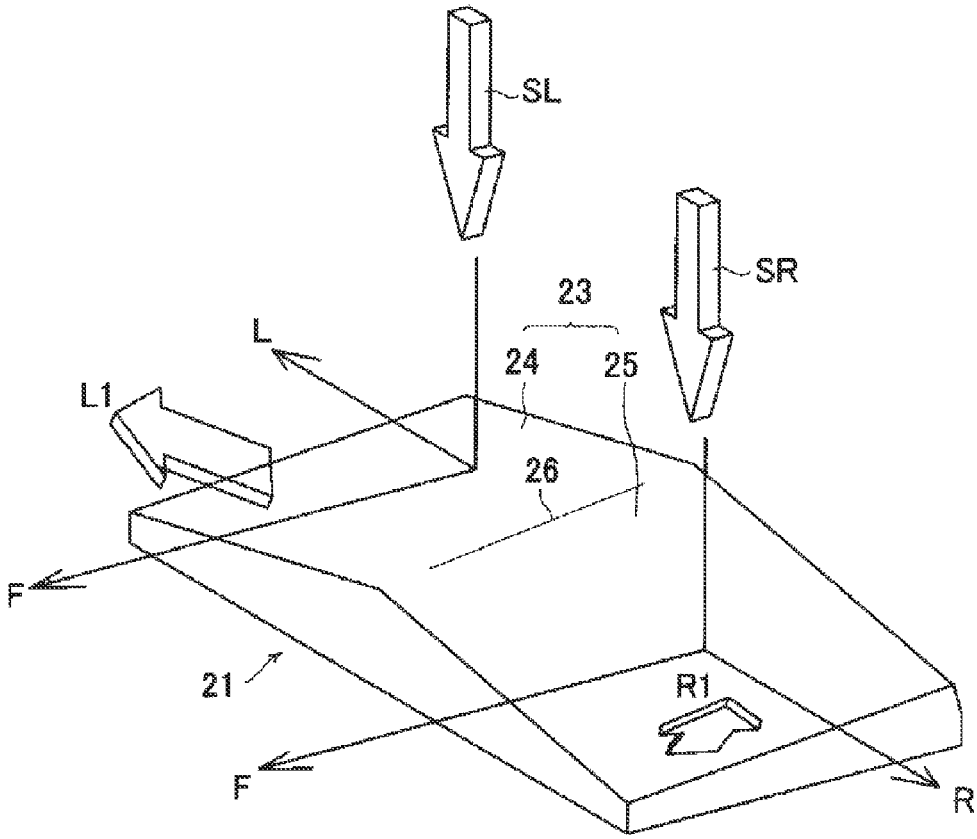
FIG. 6 is an enlarged perspective view of the base illustrated in FIG. 3, illustrating an sound reflection on the base.

FIG. 3 is a perspective view illustrating the left segment 24 and the right segment 25 of the reflecting face 23 formed by the upper face 22 of the base 21. FIG. 4 is a front elevational view of the base 21. FIG. 5 is a side elevational view of the base 21. FIG. 6 is a simplified perspective view of the base 21, and illustrates a sound reflection.

The lower face of the base 21 is placed on the floor or a table. As shown in FIGS. 3 to 5, the reflecting face 23 formed by the upper face 22 of the base 21 has a straight ridge line 26 (e.g., interface) that extends in a depth direction D3 (e.g., third direction) of the image display component A, and is located in or aligned to the center (e.g., widthwise center) of the base 21 in a widthwise direction of the reflecting face 23 that is parallel to the widthwise direction D1. This ridge line 26 serves as the boundary between the left segment 24 and the right segment 25. The left segment 24 and right segment 25 of the reflecting face 23 are both formed as a sloped flat surface, but it is also possible for the left segment 24 and right segment 25 to be formed as a concave surface face with a large radius of curvature. The base 21 has a symmetrical shape relative to the center axis of the image display component A that is aligned to the center of the base 21.

As shown in FIG. 3, the left segment 24 of the reflecting face 23 has a front-down gradient θ1 that slopes downward as moving toward a front direction F along the depth direction D3, and a left-down gradient θ2 that slopes downward as moving toward a left direction L along the widthwise direction D1. In other words, the left segment 24 slopes downward as moving away from the right segment 25 and forward of the image display component A. Accordingly, front-down and left-down slope gradients are imparted to the left segment 24. Similarly, the right segment 25 of the reflecting face 23 has a front-down gradient θ1 that slopes downward as moving toward the front direction F along the depth direction D3, and a right-down gradient θ2 that slopes downward as moving toward a right direction R along the widthwise direction D1. In other words, the right segment 25 slopes downward as moving away from the left segment 24 and forward of the image display component A. Accordingly, front-down and right-down slope gradients are imparted to the right segment 25. The value of the left-down gradient θ2 of the left segment 24 is equivalent to the value of the right-down gradient θ2 of the right segment 25. Auxiliary lines 100 are added as imaginary lines in FIG. 3 to aid an understanding of the above.

As shown by the auxiliary lines 100 in 3, and as shown in FIGS. 4 and 5, as a means for imparting front-down and left-down slope gradients to the left segment 24 of the reflecting face 23, and for imparting front-down and right-down slope gradients to the right segment 25 of the reflecting face 23, a rear end 26*b* of the ridge line 26 is made higher than a front end 26*a*, and a rear edge outer end 24*d* of the left segment 24 and a rear edge outer end 25*d* of the right segment 25 are made higher than a front edge outer end 24*c* and a front edge outer end 25*c* thereof, and tower than the rear end 26*b* of the ridge line 26. Furthermore, as shown in FIGS. 3 and 4, the base 21 includes a left base section 21*a* (e.g., first base section) with the left segment 24 and a right base section 21*b* (e.g., second base section) with the right segment 25. The left base section 21*a* has a first thickness measured in the height direction D2. The first thickness decreases as moving away from the right base section 21*b* and forward of the image display component A. Moreover, the right base section 21*b* has a second thickness measured in the height direction D2. The second thickness decreases as moving away from the left base section 21*a* and forward of the image display component A.

Figure 7:
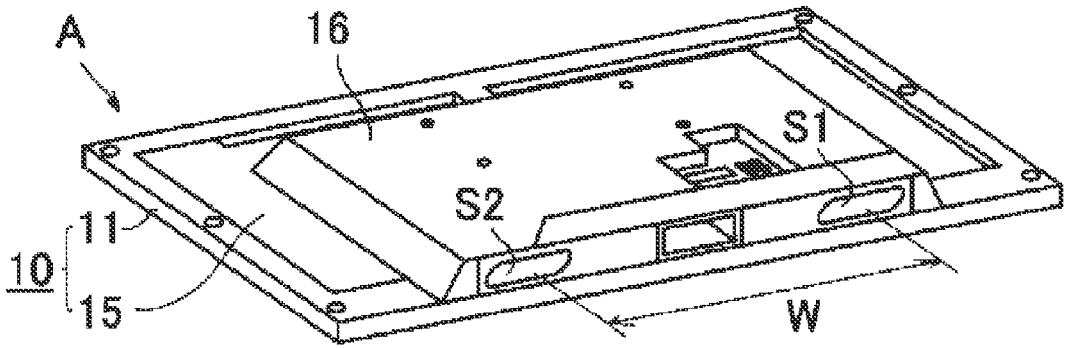
FIG. 7 is a rear perspective view of an image display component of the flat-screen television receiver illustrated in FIG. 1.

As can be seen from FIGS. 1 and 2, the left speaker S1 is disposed facing down and directly above the left segment 24 of the reflecting face 23, while the right speaker S2 is disposed facing down and directly above the right segment 25 of the reflecting face 23. Therefore, nearly all of the sound (sound waves) outputted from the left speaker S1 hits the left segment 24 of the reflecting face 23 and is reflected, and nearly all of the sound (sound waves) outputted from the right speaker S2 hits the right segment 25 of the reflecting face 23 and is reflected. Furthermore, as shown in FIGS. 1 and 2, a dimension between the left speaker S1 and the left segment 24 in the height direction D2 increases as moving away from the right segment 25 and forward of the image display component A, and a dimension between the right speaker S2 and the right segment 25 in the height direction D2 increases as moving away from the left segment 24 and forward of the image display component A. Moreover, as shown in FIGS. 1 and 7, the left and right speakers S1 and S2 are spaced apart from each other with the spacing W. The spacing W is smaller than a widthwise dimension of the base 21 measured in the widthwise direction D1.

The action will be described through reference to FIG. 6. In this drawing, sound outputted from the left speaker S1 is indicated by the downward arrow SL, and sound outputted from the right speaker S2 is indicated by the downward arrow SR. Viewed from the front, to the left is indicated by the arrow L, to the right by the arrow R, and in front of the image display component A (see FIGS. 1 and 2) by the arrow F.

As discussed above, the front-down and left-down slope gradients are imparted to the left segment 24 of the reflecting face 23, and the front-down and right-down slope gradients are imparted to the right segment 25. Furthermore, the left speaker S1 is disposed facing down and directly above the left segment 24 of the reflecting face 23, and the right speaker S2 is disposed facing down and directly above the right segment 25 of the reflecting face 23. Accordingly, nearly all of the sound SL outputted from the left speaker S1 hits the left segment 24 of the reflecting face 23 and is reflected, and is spread out forward and to the left as shown by the arrow L1. Similarly, nearly all of the sound SR outputted from the right speaker S2 hits the right segment 25 of the reflecting face 23 and is reflected, and is spread out forward and to the right as shown by the arrow R1. Accordingly, although the sounds SL and SR outputted from the left and right speakers S1 and 52 are both directed downward, there is an increase in the sound pressure toward the front of the image display component of the sounds SL and SR outputted from the left and right speakers S1 and S2. Furthermore, of the sounds SL and SR outputted from the left and right speakers S1 and S2, the sound L1 spread out forward and to the left is heard by the left ear, while the sound R1 spread out forward and to the right is heard by the right ear. Thus, the difference between the left and right sounds SL and SR can be clearly distinguished by the left and right ears. As a result, the acoustic stereo sensation tends to be satisfactory. In other words, the sound L1 reflected by the left segment 24 is spread out forward and to the left, while the sound R1 reflected by the right segment 25 is spread out forward and to the right. Thus, it is less likely that a situation will occur in which the left and right sounds L1 and R1 are mixed, and this helps to further enhance the stereo sensation.

As shown in FIG. 3, the straight ridge line 26 serves as a boundary between the left segment 24 and right segment 25 of the reflecting face 23 formed by the upper face 22 of the base 21. However, the ridge line 26 can instead be rounded, or the apex portion of the ridge line 26 can be flat. Furthermore, the plan view shape of the left segment 24 and the right segment 25 can be something other than rectangular, such as semicircular. These variations can be suitably selected by taking into account the design of the base 21.

The flat-screen television receiver includes the stand 20 having the base 21, the image display component A supported on this stand 20, and the left and right speakers S1 and S2 that are arranged on the left and right sides in front view. The upper face 22 of the base 21 is formed as the reflecting face 23 for the sound outputted from the left and right speakers S1 and S2. This reflecting face 23 is divided in two into the left segment 24 located under the left speaker S1 and the right segment 25 located under the right speaker S2. The front-down and left-down slope gradients are imparted to the left segment 24 of the reflecting face 23, and the front-down and right-down slope gradients are imparted to the right segment 25 of the reflecting face 23.

The stand 20 can be installed in other electrical device other than the flat-screen television receiver, such as a monitor without a television tuner.

With this flat-screen television receiver, sound outputted from the left speaker S1 is reflected by the left segment 24 of the sound reflecting face 23 formed on the base 21 of the stand 20, and disperses forward and to the left. Similarly, sound outputted from the right speaker S2 is reflected by the right segment 25 of the sound reflecting face 23 formed on the base 21 of the stand 20, and disperses forward and to the right. Accordingly, even though the left and right speakers S1 and S2 are installed facing down, and the sound outputted from these speakers S1 and S2 is directed downward, there is an increase in the sound pressure toward the front of the image display component A of the sound outputted from the left and right speakers S1 and S2. Furthermore, the difference in the sounds outputted from the left and right speakers S1 and S2 can be clearly distinguished by the left and right ears in front of the image display component A, which tends to provide a satisfactory acoustic stereo sensation.

Also, since the upper face 22 of the base 21 of the stand 20 is utilized as the sound reflecting face 23, an advantage is that the acoustic effects of sound pressure and stereo sensation can be improved without having to add any new parts. Another advantage is that the acoustic effects of sound pressure and stereo sensation can be improved without having to use expensive speakers that are compact and high-quality.

With the flat-screen television receiver, it is preferable if the left speaker S1 is disposed facing down and directly above the left segment 24 of the reflecting face 23, and the right speaker S2 is disposed facing down and directly above the right segment 25 of the reflecting face 23. With this arrangement, sound directed downward by the left speaker S1 will be efficiently reflected by the left segment 24 of the reflecting face 23, and sound directed downward by the right speaker S2 will be efficiently reflected by the right segment 25 of the reflecting face 23, which affords an increase in the above-mentioned forward sound pressure and an even better stereo sensation resulting from spreading out of the sound to the left and right.

With the flat-screen television receiver, the image display component A can have a configuration in which the liquid crystal module 8 is built into the cabinet 10, and the left and right speakers S1 and S2 are installed at the lower end of the cabinet 10 and at the rear of the liquid crystal module 8. Therefore, the acoustic performance of the flat-screen television receivers that are intended to be very thin can be improved.

As discussed above, with the flat-screen television receiver, the upper face 22 of the base 21 of the stand 20 is utilized as the sound reflecting face 23, which makes it possible to increase forward sound pressure and to improve the user's stereo sensation, without adding any new parts for improving the acoustic effect, or using expensive speakers that are compact and high-quality. Thus, it is possible to provide a flat-screen television receiver with excellent acoustic effect at a low price.

Furthermore, reflection of sound by the stand 20 is utilized to allow an increase in the sound pressure toward the front of the cabinet, and to improve the acoustic stereo sensation, even though the left and right speakers S1 and S2 are installed facing down, and it is difficult for the speakers S1 and S2 to be spaced widely apart.

GENERAL INTERPRETATION OF TERMS

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts.

While selected embodiments have been chosen to illustrate the present invention, it will be apparent to those skilled in the art from these disclosures that various changes and modifications can be made herein without departing from the scope of the invention as defined in the appended claims. Furthermore, the foregoing descriptions of the selected embodiments according to the present invention are provided for illustration only, and not for the purpose of limiting the invention as defined by the appended claims and their equivalents.

What is claimed is:

1. A display device comprising;

an image display component;

first and second speakers mounted to the image display component, the first and second speakers being spaced apart from each other in a first direction of the image display component;

a stand supporting the image display component, the stand including a base with first and second sound reflecting faces, the first and second sound reflecting faces being arranged relative to each other in the first direction of the image display component, the first and second sound reflecting faces being opposite the first and second speakers in a second direction of the image display component, respectively, with the second direction being perpendicular to the first direction, the first sound reflecting face sloping downward as moving away from the second sound reflecting face and forward of the image display component, the second sound reflecting face sloping downward as moving away from the first sound reflecting face and forward of the image display component.

2. The display device according to claim 1, wherein the base has a top surface that forms the first and second sound reflecting faces.

3. The display device according to claim 1, wherein the first and second speakers are arranged relative to the first and second sound reflecting faces such that the first and second speakers emit sound in the second direction of the image display component toward the first and second sound reflecting faces, respectively.

4. The display device according to claim 1, wherein the first and second speakers are arranged such that the first and second speakers overlap the first and second sound reflecting faces, respectively, as viewed in the second direction of the image display component.

5. The display device according to claim 1, wherein the image display component further includes a cabinet and a liquid crystal module that is disposed within the cabinet, the first and second speakers being mounted to a bottom portion of the cabinet at a location rearward of the image display component relative to the liquid crystal module.

6. The display device according to claim 5, wherein the cabinet includes front and rear cabinet parts, the rear cabinet part including a bulging portion, the first and second speakers being disposed within the bulging portion of the rear cabinet part.

7. The display device according to claim 1, wherein the base has a symmetrical shape relative to a center axis of the image display component with the center axis of the image display component extending along the second direction of image display component.

8. The display device according to claim 1, wherein the first and second sound reflecting faces having an interface that is aligned to a widthwise center of the image display component in the first direction of the image display component.

9. The display device according to claim 1, wherein the first and second sound reflecting faces are arranged such that a dimension between the first speaker and the first sound reflecting face in the second direction of the image display component increases as moving away from the second sound reflecting face and forward of the image display component, and a dimension between the second speaker and the second sound reflecting faces in the second direction increases as moving away from the first sound reflecting face and forward of the image display component.

10. The display device according to claim 1, wherein the first and second speakers are symmetrically arranged relative to each other with respect to a center axis of the image display component with the center axis of the image display component extending along the second direction of image display component.

11. The display device according to claim 1, wherein the first and second sound reflecting faces are arranged relative to the first and second speakers such that the first and second sound reflecting faces are configured to reflect sound emitted from the first and second speakers, respectively.

12. The display device according to claim 1, wherein the base includes a first base section with the first sound reflecting face and a second base section with the second sound reflecting face, the first base section having a first thickness measured in the second direction of the image display component with the first thickness decreasing as moving away from the second base section and forward of the image display component, the second base section having a second thickness measured in the second direction of the image display component with the second thickness decreasing as moving away from the first base section and forward of the image display component.

13. The display device according to claim 1, wherein the first and second sound reflecting faces includes sloped flat surfaces, respectively.

14. The display device according to claim 1, wherein the first and second speakers are spaced apart from each other with a predetermined spacing that is smaller than a widthwise dimension of the base measured in the first direction of the image display component.

* * * * *